United States Patent [19]

Barnes

[11] Patent Number: 4,709,687

[45] Date of Patent: Dec. 1, 1987

[54] GAS COOKERS

[75] Inventor: Hugh V. Barnes, Sutton Coldfield, England

[73] Assignee: TI Gas Spares Limited, London, England

[21] Appl. No.: 909,633

[22] Filed: Sep. 22, 1986

[30] Foreign Application Priority Data

Jun. 12, 1985 [GB] United Kingdom ..... 8530060
Sep. 20, 1985 [GB] United Kingdom ..... 8523248

[51] Int. Cl.[4] ..... F24C 3/12
[52] U.S. Cl. ..... 126/42; 137/495
[58] Field of Search ..... 126/39 E, 42; 431/153; 137/495

[56] References Cited

U.S. PATENT DOCUMENTS 1,972,627 9/1934 Lindemann et al. ..... 126/42
2,314,095 3/1943 Lawrence ..... 126/42
2,833,304 5/1958 Fish ..... 137/495

*Primary Examiner*—Samuel Scott
*Assistant Examiner*—Noah Kamen
*Attorney, Agent, or Firm*—Solon B. Kemon

[57] ABSTRACT

A gas cooker is described which includes a gas hob having a number of gas burners 1 each having a hob tap 3 for controlling the supply of gas thereto, a lid 7 movable between an open position giving access to the burners and a closed position in which the lid covers the burners, and a gas control valve 10 controlling the supply of gas to the hob taps 3, the gas control valve 10 being operatively connected to the lid 7 whereby when the lid is closed the gas supply to the taps 3 is cut-off and when the lid is open the gas supply is restored, the gas control valve 10 being further provided with a pressure operated valve 16, 19 for preventing the restoration of the gas supply to the hob taps 3 on movement of the lid 7 to its open position unless all the hob taps are "OFF" (FIGS. 1 and 2).

3 Claims, 3 Drawing Figures

GAS COOKERS

BACKGROUND OF THE INVENTION

1. Field of the Invention

This invention relates to gas cookers and is particularly applicable to gas cookers in the form of gas hobs or gas grill chambers. These may be independent units or may form part of a conventional multi-function cooker which may include a hob, a grill chamber, a grill/oven chamber, a single oven or a double oven or any appropriate combination thereof.

2. Description of the Prior Art

It is known to fit gas hobs with lids that open to give access to one or more burners. When closed, the lid covers the burners thereby protecting the latter and providing a "clean" line to the surface of the hob or cooker.

To allow a user to close the lid when a burner is alight is extremely dangerous. The heat from the burner will damage the lid and, if the latter is of glass, may well shatter the lid. Closure of the lid may result in extinguishment of the burner flame and the consequent escape of gas, or alternatively if the flame is not extinguished, poor combustion of the gas and damage to the lid.

Safety measures have been proposed which ensure that the supply of gas is automatically cut-off to all the hob burners when the lid is closed but such measures are not entirely satisfactory in that in some arrangements when the lid is closed with one of the gas burners alight, although the supply of gas to the burners is cut-off, when the lid is re-opened the supply of gas to the burner that was previously alight is restored, thereby allowing un-ignited gas to escape from the burner. Such an arrangement is obviously dangerous.

A similar problem can arise with gas grill chambers in which it is sometimes necessary to provide a gas control valve operated by the grill chamber door to ensure that if the grill chamber door is closed with the grill burner alight, then the gas supply to the grill burner is cut-off. However, when the grill chamber door is again opened, because the grill burner had previously been alight, un-ignited gas will be emitted from the grill burner. Again, such an arrangement is obviously dangerous.

SUMMARY OF THE INVENTION

It is an object of the present invention to provide a gas cooker in which the gas supply to a burner will not be restored unless the tap associated with that burner is "OFF".

According to the present invention, there is provided a gas cooker having one or more gas burners, a lid or door movable between an open position giving access to the burner or burners and a closed position preventing access to the burner or burners, one or more taps for controlling the supply of gas to a respective burner or burners and a gas control valve controlling the supply of gas to the tap or taps and operatively connected to the lid or door in a manner such that movement of the lid or door into its closed position operates the gas control valve to terminate the supply of gas to the tap or taps, while lid or door movement from the closed to the open position restores the supply, the gas control valve incorporating means for preventing the restoration of the supply of gas to the tap or taps on movement of the lid or door into its open position unless all the taps are "OFF".

In a preferred arrangement for carrying out the invention the means for preventing the restoration of the supply of gas to the tap or taps will include a pressure operated valve.

In carrying out the invention according to the preferred arrangement, it may be arranged that the gas control valve comprises a first valve for controlling the supply of gas to the tap or taps, the first valve being operatively connected to said lid or door in a manner such that movement of the lid or door into its closed position causes the first valve to close and movement of the lid from the closed position to the open position causes the first valve to open, and in which the pressure operated valve is operatively connected to said first valve and is responsive to gas pressure for maintaining said first valve closed when said lid or door is opened and if one or more taps are "ON".

It may be arranged that the first valve is effective for controlling the flow of gas between a gas inlet and a gas outlet of said gas control valve, a gas weep passage being provided between said gas inlet and said gas outlet, said pressure operated valve comprising spring operated diaphragm means which is responsive to the gas pressure in said gas outlet.

Advantageously it may be arranged that the first valve is carried on a valve spindle which is operatively connected to said lid or door, said diaphragm means being operatively connected to said valve spindle for controlling the operation of the first valve in dependence upon the gas pressure in said gas outlet.

In an especially preferred arrangement for carrying out the invention it will be arranged that the gas control valve comprises a further valve constituted in part by said diaphragm means for controlling the flow of gas to said gas outlet whereby the flow of gas via said gas weep passage is prevented when said lid or door is closed.

Advantageously it may be arranged that the further valve opens before the first valve thereby subjecting the diaphragm means to the pressure of said gas outlet, said diaphragm means being responsive to said pressure for controlling the operation of said first valve.

In accordance with the invention, the gas cooker may take the form of a gas hob or a gas grill chamber.

BRIEF DESCRIPTION OF THE DRAWINGS

The foregoing and other features of the invention will now be described reference being made to the accompanying drawings, in which.

DESCRIPTION OF THE PREFERRED EMBODIMENTS

Figure 1:
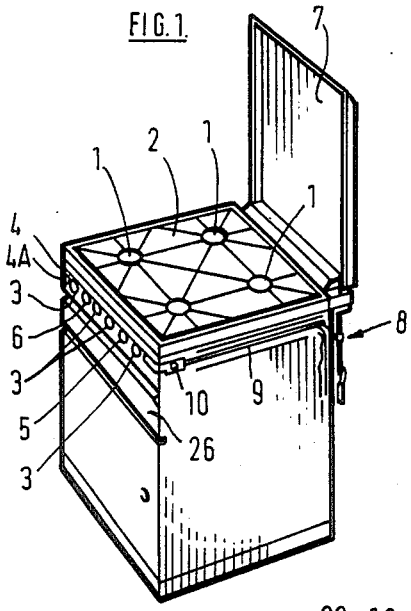
FIG. 1, is a schematic perspective view from one side of a gas cooker which includes a gas hob in accordance with the present invention.

In FIG. 1 of the drawings there is shown a gas cooker which includes a gas hob in accordance with the present invention.

Top burners indicated schematically at 1 and located above a spillage plate 2 are controlled by taps 3 located on a control panel 4. Also located on the control panel 4 are two further taps 5, 6 that control the gas supply to an oven burner (not shown) and a grill burner (not shown) respectively, together with an ignition button 4A which controls a gas ignition mechanism (not shown). The taps 3, 5, 6 are all mounted upon a gas rail (not shown) that is arranged transversely across the front of the cooker behind the control panel 4.

The cooker has a lid 7 pivotally mounted at the rear of the spillage plate 2 on a horizontal axis so as to be movable between a fully open position shown in FIG. 1 and a closed position in which the lid 7 covers the top burners 1. The closing weight of the lid is counterbalanced and in FIG. 1 a shaft forming part of the counterbalance mechanism is indicated at 8. An example of a suitable counterbalance mechanism is given in U.K. Patent Application No. 2,144,845A.

The counterbalance mechanism 8 in FIG. 1 is arranged to effect longitudinal movement of a control rod 9 such that when the lid 7 of the cooker is closed the control rod 9 moves longitudinally forwards and when the lid 7 is opened the control rod 9 moves longitudinally rearwards. The forwards and rearwards movement of the control rod 9 is used to control the operation of a gas control valve 10 which controls the supply of gas (via a gas rail—not shown) to the gas taps 3 of the cooker of Fig. 1. Thus, when the lid 7 of the cooker is closed, the control rod 9 causes the gas control valve 10 to close to cut-off the gas supply to the taps 3 and thus to the burners 1, and when the lid 7 of the cooker is opened, the control rod 9 causes the gas control valve 10 to open to restore the gas supply to the taps 3 and thus to the burners 1.

The gas control valve 10 incorporated in the gas cooker of Fig. 1 is, as will be described in greater detail with reference to Figs. 2 and 3, of a particular form which prevents gas being applied to the gas taps 3 of the cooker unless all the gas taps 3 are turned "OFF" thereby overcoming the disadvantage of prior art gas hobs hereinbefore referred to.

Figure 2:
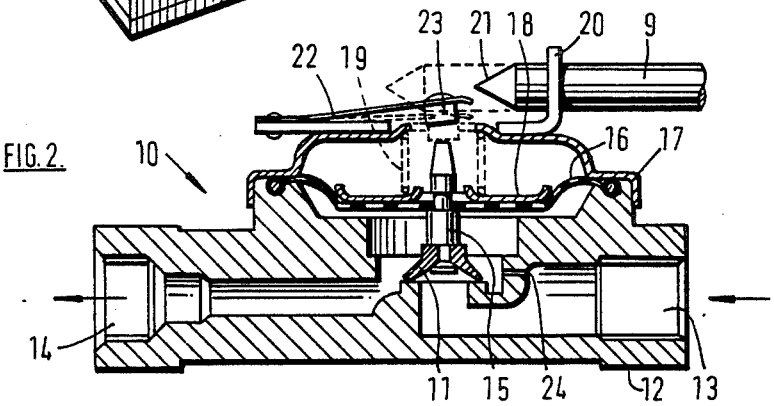
FIG. 2, is a cross-sectional view of a gas control valve for use in the gas cooker of FIG. 1.

In FIG. 2 of the drawings there is shown a cross-sectional view of one form of gas control valve 10 as embodied in the gas cooker of FIG. 1.

In the gas control valve 10 shown in FIG. 2, a valve 11 is mounted in a body 12 having a gas inlet 13 and gas outlet 14. The gas inlet 13 would normally be connected to the gas supply of the cooker and the gas outlet 14 would normally be connected to a gas rail (not shown) by means of which gas is applied to the gas taps 3 (FIG. 1) of the cooker, and thence to the burners 1 (FIG. 1) of the cooker. The valve 11 is secured to a spindle 15 which also carries a diaphragm 16 clamped in a gas tight manner in body 12 by means of a top cover 17. The diaphragm 16 carries a disc 18 and the valve 11 is urged towards its seat by a spring 19 disposed between the disc 18 and the cover 17.

Mounted on the cover 17 is a bracket 20 which forms a bearing for the free end of the control rod 9 already referred to in connection with the gas cooker of FIG. 1. As has already been explained, the control rod 9 is operated longitudinally by the action of opening and closing the lid 7 (FIG. 1) of the gas cooker of FIG. 1, its position when the lid 7 is open being shown in full lines in FIG. 2 and its position when the lid is closed being shown in dashed lines in FIG. 1.

The control rod 9 which is supported in the bracket 20 is provided with a conical end portion 21 which, on movement of the control rod 9, is arranged to co-act with a cantilevered leaf spring 22 which is also mounted on the bracket 20. The leaf spring 22 is provided with a pad 23 which is located above the end of the spindle 15 of the control valve 10. The spring 22 is biased such that when free (solid lines) the pad 23 is spaced from the end of valve spindle 15. When the control rod 9 is moved forward (dashed lines) as the result of lid 7 of the gas cooker being closed, the conical portion 21 rides against spring 22 and moves it in a downward direction (dashed lines) to cause pad 23 to press on spindle 15 to mechanically hold valve 11 on its seat.

In body 12 of the valve 10 is a small weep passage 24 between inlet 13 and outlet 14, the purpose of which will become apparent from the following description of how the gas control valve 10 operates.

Gas enters the gas control valve 10 at inlet 13 and cannot pass to outlet 14 when valve 11 is on its seat, apart from that passing through weep passage 24. If the lid 7 (FIG. 1) of the gas cooker is closed, the valve 11 is mechanically held on its seat by the control rod 9 as explained above. If a gas tap has been left "ON", the action of closing the lid will shut off the gas, apart from that through the weep passage 24 which will be given off to atmosphere via the burner associated with the tap that is "ON". Because the gas through the weep passage 24 is given off, build-up of pressure in the gas outlet 14 is prevented, so that there is insufficient gas pressure on the underside of the diaphragm 16 to overcome the action of the spring 19. Therefore, the diaphragm 16 in conjunction with the spring 19 maintains the valve 11 on its seat.

When the tap that is "ON" is turned "OFF", the small weep of gas through the weep passage 24 causes a build-up of pressure in gas outlet 14 and under diaphragm 16 until a point is reached where it is sufficient to overcome the spring 19, at which time it causes the valve 11 to be lifted off of its seat, thereby restoring gas flow to the gas outlet 4.

In this way, if the lid 7 (FIG. 1) of the gas cooker had been closed with one of the gas burners alight, then the gas control valve 10 described with reference to FIG. 2 will cut-off the gas supply to that burner, apart from that through the weep passage 24, and will ensure that the gas supply is held cut-off until all the burners are turned "OFF".

One problem with the gas control valve of FIG. 2 is that, as has been described, because of the weep passage 24 there will be a small leakage of gas through any burner that had been left "ON" and this leakage, although small and acceptable in some situations is nonetheless undesirable.

Figure 3:
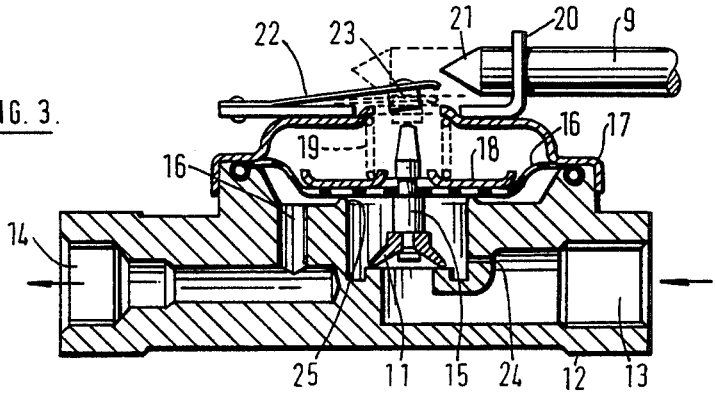
FIG. 3, is a cross-sectional view of a modified form of the gas control valve of FIG. 2.

In FIG. 3 of the drawings there is shown a modification of the gas control valve 10 of FIG. 2 in which the leakage of gas whilst the cooker lid is closed is obviated.

In the gas control valve depicted in FIG. 3, the gas flow path between the gas inlet 13 and the gas outlet 14 is modified so that it passes between the diaphragm 16 and a raised valve seat 25 onto which the diaphragm 16 is pressed when the valve 11 is held on its seat by the lid. To achieve this valve 11 is made flexible so that valve 11 may be seated at the same time as diaphragm 16 is pressed against the raised valve seat 25. After passage between the diaphragm 16 and the raised valve seat 25, gas flows via an auxiliary passage 26 to the gas outlet 14.

The operation of the gas control valve 10 of FIG. 3 is as follows:

If the lid of the gas cooker to which the gas control valve 10 is fitted is closed, then valve 11 and diaphragm 16 are held in their respective seats by control rod 9. In this position the main gas flow path is obstructed by valve 11 and the diaphragm 16. In addition, gas flow through the weep passage 24 is prevented by the diaphragm 16 on its valve seat 25 Thus, undesirable gas leakage whilst the cooker lid is closed is obviated, even if one or more of the gas taps had been left "ON".

When the cooker lid is raised, due to the flexibility of the valve 11, it remains seated but the diaphragm 16 lifts away from the valve seat 25. This allows weep gas to pass into outlet 14.

If all of the gas taps are "OFF" then pressure builds up in gas outlet 14 and under diaphragm 16 to subsequently cause valve 11 to be lifted from its seat to restore gas flow from the gas inlet 13 to the gas outlet 14.

If one or more of the gas taps are "ON" then weep gas will leak from the or each respective burner and will prevent pressure build-up in gas outlet 14 and under the diaphragm 16. The valve 11 will therefore remain seated and will prevent the main gas flow between the gas inlet 13 and the gas outlet 14. There will still be a small leakage through the weep 24 but this will only occur when the lid is open and when one or more of the gas taps are "ON".

The foregoing embodiment of the invention has been confined to the use of the gas control valve 10 of FIGS. 2 and 3 being used in order to control the gas flow to the top burners 1 of the gas cooker of FIG. 1.

However, it should be appreciated that a separate gas control valve could also be used in conjunction with the grill chamber of the cooker of FIG. 1, it having already been described that a tap 6 is provided on the control panel 4 for controlling gas supply to a grill burner (not shown). In FIG. 1, a grill chamber door is shown at 26 and it will easily be appreciated how this may be interlinked to a gas control valve 10 as described in relation to FIGS. 2 and 3 for controlling the gas supply to the grill tap 6 in order to ensure that the gas supply to the grill tap 6 and thus to the grill burner (not shown) is not restored until the grill tap 6 is "OFF".

I claim:

1. A gas cooker comprising at least one gas burner, a lid or door movable between an open position giving access to the at least one burner and a closed position preventing access to the at least one burner, at least one tap for controlling the supply of gas to a respective burner and a gas control valve controlling the supply of gas to the at least one tap and operatively connected to the lid or door such that movement of the lid or door into its closed position opeates the gas control valve to terminate the supply of gas to the at least one tap, while lid or door movement from the closed to the open position restores the supply, the gas control valve including a first valve for controlling the supply of gas to the at least one tap, a valve spindle on which the first valve is carried and which is operatively connected to said lid or door, a pressure operated surface means carried by said valve spindle and a responsive to gas pressure for maintaining said first valve closed when said lid or door is opened and said at least one tap is "ON", a weep passage by passing said first valve, and a further valve constituted in part by said pressure operated surface means for controlling the flow of gas through said weep passage whereby the flow of gas via said weep passage is prevented when said lid or door is closed.

2. A gas cooker as claimed in claim 1, in which the gas control valve comprises a gas inlet and a gas outlet, the first valve being effective for controlling the flow of gas between said gas inlet and said gas outlet, said pressure operated surface means comprising spring operated diaphragm means which is responsive to the gas pressure in said gas outlet.

3. A gas cooker as claimed in claim 2, in which the further valve opens before said first valve thereby subjecting the diaphragm means to the pressure of said gas outlet whilst said first valve is closed, said diaphragm means being responsive to said pressure for controlling the operation of said first valve.

* * * * *